US005359914A

United States Patent [19]

Brown

[11] Patent Number: 5,359,914

[45] Date of Patent: Nov. 1, 1994

[54] TWO PART URETHANE PUNCH STRIPPER

[76] Inventor: Richard H. Brown, 4850 Meadowbrook Rd., Williamsville, N.Y. 14221

[21] Appl. No.: 84,571

[22] Filed: Jun. 29, 1993

[51] Int. Cl.[5] ..... B26F 1/14

[52] U.S. Cl. ..... 83/139; 83/142

[58] Field of Search ..... 83/138, 139, 142

[56] References Cited

U.S. PATENT DOCUMENTS

| | | | |
|---|---|---|---|
| 2,230,043 | 1/1941 | Moran . | |
| 2,807,323 | 9/1957 | Taylor . | |
| 3,211,035 | 10/1965 | Whistler, Sr. et al. . | |
| 3,234,835 | 2/1966 | Archbold et al. . | |
| 3,269,238 | 8/1966 | Whistler, Sr. et al. . | |
| 3,485,122 | 12/1969 | Achler et al. . | |
| 3,690,205 | 9/1972 | Brown . | |
| 3,871,254 | 3/1975 | Whistler, Jr. et al. . | |
| 4,104,941 | 8/1978 | Krueger | 83/139 X |
| 4,107,842 | 8/1978 | MacKeigan | 83/139 X |
| 4,215,608 | 8/1980 | Herlan . | |
| 4,235,138 | 11/1980 | Creighton, Jr. et al. | 83/139 |
| 4,261,237 | 4/1981 | DiDonato, Jr. et al. | 82/139 |
| 4,428,262 | 1/1984 | Vlahek . | |
| 4,784,031 | 11/1988 | Dixon | 83/139 X |
| 5,138,919 | 8/1992 | Wilhelm | 83/139 |

*Primary Examiner*—Rinaldi I. Rada
*Attorney, Agent, or Firm*—John C. Thompson

[57] ABSTRACT

A novel two part punch stripper (10) for use with punches (12) carried by a punch press (16). The novel two part urethane punch stripper of this invention includes generally cylindrical concentric tubular upper and lower parts (50 and 52). The lower part (52) is formed of a urethane of a conventional hardness for a punch stripper, the hardness being in the range of 80A to 100A (Shore). The tubular upper part (50) is formed of a urethane substantially harder than the lower part of the stripper, for example, in the range of 75D (Shore). The combined length of the upper and lower parts is greater than the length of the portion of the punch which extends below the punch retainer assembly (14) so that a proper preload can be achieved. The upper part and lower parts are bonded to each other by a suitable adhesive. Alternatively, they may be bonded to each other by sequentially casting in a common mold.

6 Claims, 2 Drawing Sheets

Fig. 6.
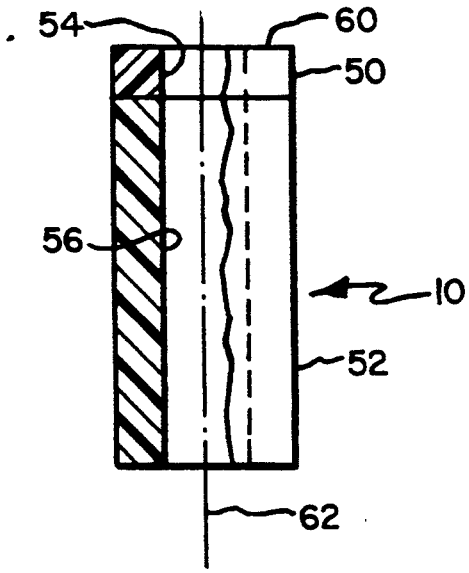
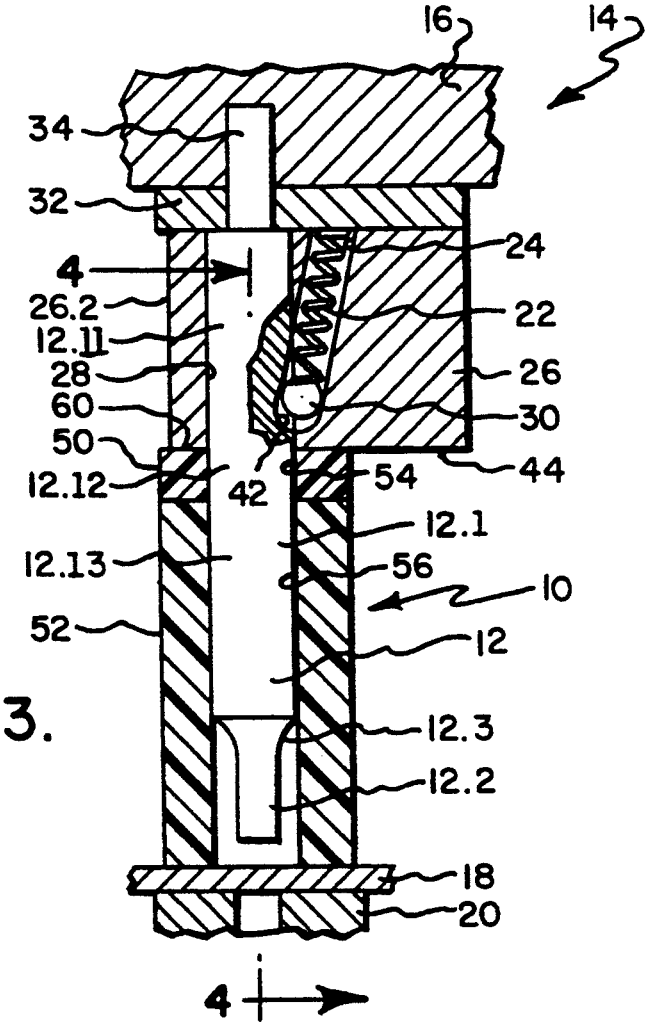
Fig. 3.
Fig. 4.
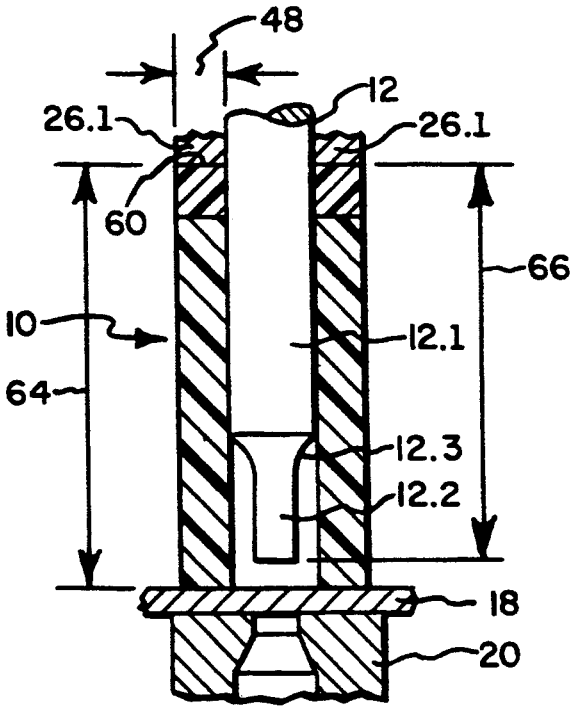
Fig. 5.
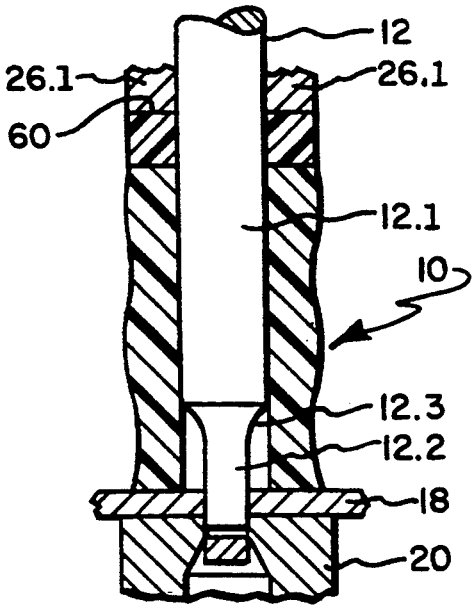

TWO PART URETHANE PUNCH STRIPPER

TECHNICAL FIELD

The present invention relates generally to strippers for use with punches carried by a punch press, and more particularly to a novel two part punch stripper having a generally cylindrical tubular lower part formed from a urethane of conventional hardness and a generally cylindrical tubular upper part formed from a urethane which is substantially harder than the lower part of the stripper.

BACKGROUND OF THE INVENTION

Punch strippers employing a rubber-like material are well known in the art. These strippers resiliently deflect upon compression but resume their original shape after the compression has been released due to their resilient nature. When they resume their original shape, they will strip the punched workpiece from the punch. U.S. Pat. No. 2,230,043 issued Jan. 28, 1941, shows an early design of such a stripper wherein a rubber spool is disposed about a punch. The rubber spool has bearing plates at each end of the stripper so that it may be applied to the punch either end up. The bearing plates are designed to fit the surface of the sheet metal work. U.S. Pat. No. 2,807,323 also disclothes a resiliently deformable stripper wherein the stripper includes two parts in FIG. 1, the harder part being disposed adjacent the workpiece. In FIG. 5 of this patent, the stripper is formed of dense and soft washers, the softer washer being disposed at either end of the stack. U.S. Pat. No. 3,234,835 discloses that the stripper may be made of a urethane material. U.S. Pat. No. 3,690,205 discloses a two part stripper having a relatively soft urethane tubular portion and a harder nylon portion which contacts the workpiece. Other relevant U.S. Pat. Nos. are 3,211,035, 3,269,238, 3,485,122, 3,871,254, 4,215,608, and 4,428,262.

One problem with urethane strippers which has existed over the years is that while they are relatively durable, they will tear if cut. Thus, all sharp edges of dies and retainers which might come into contact with the urethane stripper must be eliminated to prevent cutting or tearing of the urethane when under load. In recently developed punch assemblies, the surface area of the retainer to be contacted by the stripper is frequently quite small, causing the relatively soft urethane of conventional strippers to extend beyond the surface area of the retainer contacted by the stripper. This will frequently cause tearing or other damage to the stripper.

OBJECTS AND SUMMARY OF THE INVENTION

It is an object of the present invention to provide a novel two part urethane punch stripper which is less susceptible to tearing, particularly when used with punch retainers which have a surface area which does not extend beyond the urethane stripper in all radial directions.

The novel two part urethane punch stripper of this invention includes a generally cylindrical concentric tubular upper and lower parts. The lower part is formed of a urethane of conventional hardness for a punch stripper, the hardness being in the range of 80A to 100A (Shore). The tubular upper part is formed of a urethane substantially harder than the lower part of the stripper, for example, in the range of 75D (Shore). The upper and lower parts are bonded to each other. Thus, they may be formed by pouring one part into a mold, for example, the material which forms the substantially harder part, and then by pouring the other part, for example, the softer material, into the mold, the two parts bonding to one another. Alternatively, the parts may be cut from tubular stock and bonded to each other by a suitable adhesive. The combined length of the upper and lower parts is greater than the length of the portion of the punch which extends below the punch retainer so that a proper preload can be achieved.

The preceding objects and other objects and advantages of this invention will be understood after a consideration of the following detailed description taken in conjunction with the accompanying drawings in which a preferred form of this invention is illustrated.

BRIEF DESCRIPTION OF THE DRAWINGS

FIG. 3 is a sectional view through the two part urethane punch stripper of this invention, the punch stripper being disposed about a punch held within a punch retainer which is in turn supported by the press plate of a punch press, the stripper being shown in that position where it initially contacts the upper surface of a workpiece supported upon a die.

FIG. 4 is a sectional view taken generally along the line 4—4 in FIG. 3.

FIG. 5 is a sectional view similar to FIG. 4 but showing the relationship of the parts after the punch has punched a slug from the workpiece.

FIG. 6 is a view similar to FIG. 2, but showing an open end two part urethane punch stripper of this invention.

DETAILED DESCRIPTION

Figure 1:
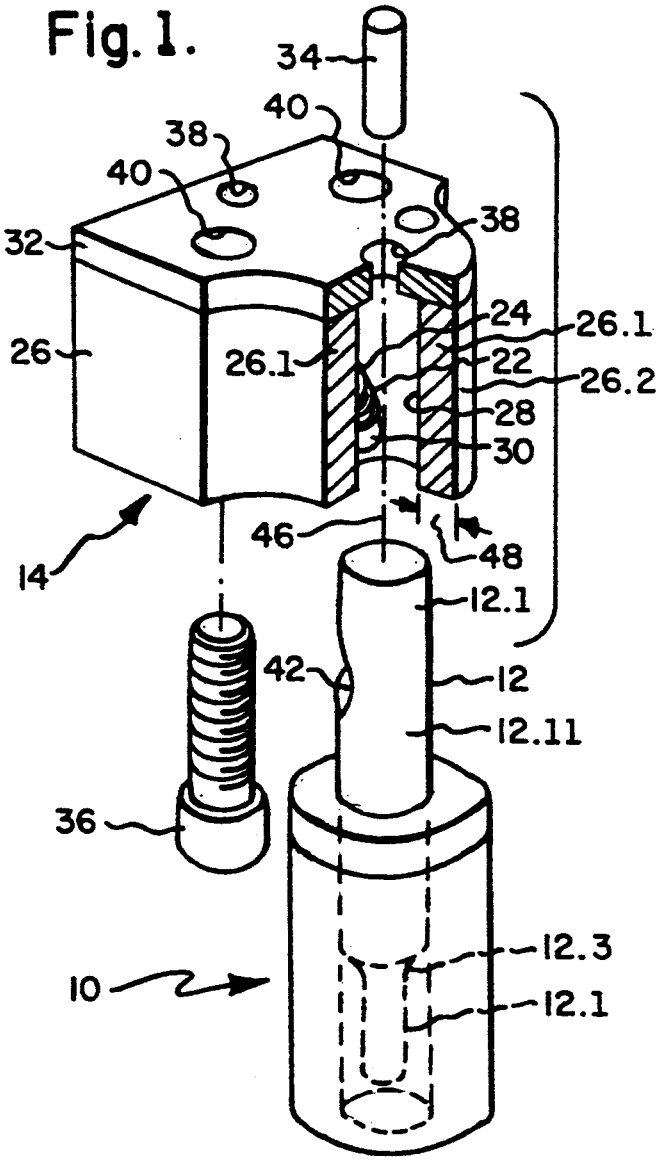
FIG. 1 is an exploded perspective view of the assembly which employs the two part urethane punch stripper of this invention, the punch stripper being disposed about a punch which is retained within a punch retainer of the type shown.

The two part urethane punch stripper of this invention is indicated generally at 10. It is intended to be used with a punch 12 of the type supported by a punch retainer assembly indicated generally at 14. As can be seen best from FIG. 3, the punch retainer assembly is in turn secured to an upper movable portion of a punch press, such as a press plate 16. The punch 12 is used to punch holes in workpieces 18 that are in turn supported on a die 20 carried by a lower fixed portion of the punch press. The punch 12 is of conventional construction having an upper cylindrical shank portion 12.1, a lower working end portion 12.2, and a transition portion 12.3 which extends between the shank portion and the working portion.

The punch 12 is adapted to be supported within the retainer assembly 14, and to this end the retainer assembly has a ball lock mechanism including a coil spring 22 disposed within an inclined bore 24 formed within a retainer block 26. The inclined bore 24 intersects a vertically extending cylindrical cavity 28 (FIG. 1) formed within the retainer block. A ball 30 is disposed in the lower end of the inclined bore 24, and a portion of the ball 30 projects into the cavity 28. The lower end of the coil spring 22 bears against the ball, and the upper end of the spring is retained within the bore by a backing plate 32 which is permanently attached to the retainer block 26 in a conventional manner. The spring 22 is under compression when the backing plate is attached to the retainer block as illustrated. The punch retainer assembly 14 can be easily mounted to the punch plate 16 by premachined dowel pins 34 and screws 36. To this end, the retainer block 26 and backing plate 32 are provided with suitable apertures 38 and 40 for the reception of dowel pins 34 and screws 36, only one screw and one dowel pin being illustrated in FIG. 1. An upper section 12.11 of the cylindrically upper shank portion 12.1 of the punch 12 is provided with a shallow depression 42 of a substantially teardrop shape. To mount the punch within the retainer, it is necessary only to telescope the upper section 12.11 of the cylindrical upper portion of the punch into the cylindrical cavity or bore 28 until the ball 30 is received within the teardrop depression 42.

The form of retainer block illustrated has a relatively thin wall 26.1 extending about the cylindrical cavity 28 approximately 180° as can be seen best from FIGS. 1 and 4. Thus, the retainer block 26 has a lower surface 44 (FIG. 3) which extends normally to the centerline 46 (FIG. 1) of the vertically extending cylindrical cavity 28 (and of the centerline of the punch 12 when it is mounted within the cavity 28). The portion of the lower surface 44 below the thin wall portion 26.1 has a relatively short radial length 48 (FIG. 1).

Figure 2:
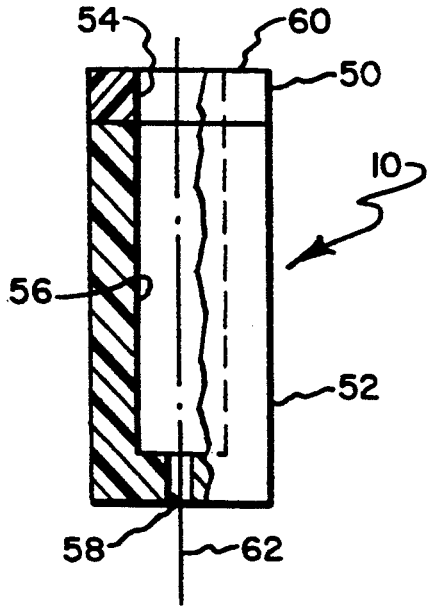
FIG. 2 is a partial sectional view through a closed end two part urethane punch stripper of this invention.
Figure 7:
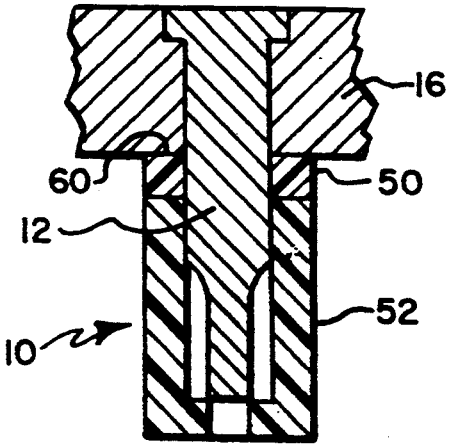
FIG. 7 is a simplified sectional view showing this invention applied to a shoulder punch.

Three forms of the two part urethane punch stripper of this invention are illustrated in the drawings. The differences between these forms can be appreciated best from an inspection of FIGS. 2, 6 and 7. In FIG. 2 a closed end stripper is illustrated. This form of stripper includes a generally cylindrical tubular upper part 50 and a generally cylindrical tubular lower part 52. Each of the tubular parts 50 and 52 are of substantially the same diameter. Each of the parts 50 and 52 has a concentric bore. Thus the generally cylindrical tubular upper part 50 has a concentric cylindrical bore 54. The cylindrical lower part 52 is provided with a concentric cylindrical bore 56. The bores 54 and 56 are of the same diameter. In the closed end design, shown in FIG. 2, bore 56 terminates before the lowermost end of the lower part 52. The closed end of the lower portion 52 initially has an air vent 58. This air vent 58 is frequently smaller than the lower working end 12.2 of the punch and it should be appreciated that during the first punching operation the closed end may be punched out to a size which conforms to the working end of the punch. By utilizing a closed end design, there is a greater surface contact between the stripper and the workpiece and it is believed, at least with some workpiece finishes, that this may reduce marring of the workpieces. In addition, when open-end strippers of the type shown in FIG. 6 are utilized with thin stock, there is a tendency to pull the thin stock up into the tube about the punch point. In the open end design, which is shown in FIG. 6, the lower bore 56 extends through the entire length of the tubular lower part 52. The shoulder design shown in FIG. 7 operates generally in the same manner as the closed end design shown in FIG. 2. In the designs shown in FIGS. 2, 6 and 7, the generally cylindrical tubular lower part 52 is formed of a urethane of conventional hardness for a punch stripper. Thus the urethane of the lower part 52 generally has a hardness of between 80A and 100A on the Shore scale. In the designs shown in FIGS. 2, 6 and 7, the upper part 50 is formed of a urethane substantially harder than the lower part 52, the upper part having a hardness in the range of 75D on the Shore scale. The tubular upper and lower parts 50, 52 may be molded together, or may be secured to each other by a suitable adhesive.

Figure 8:
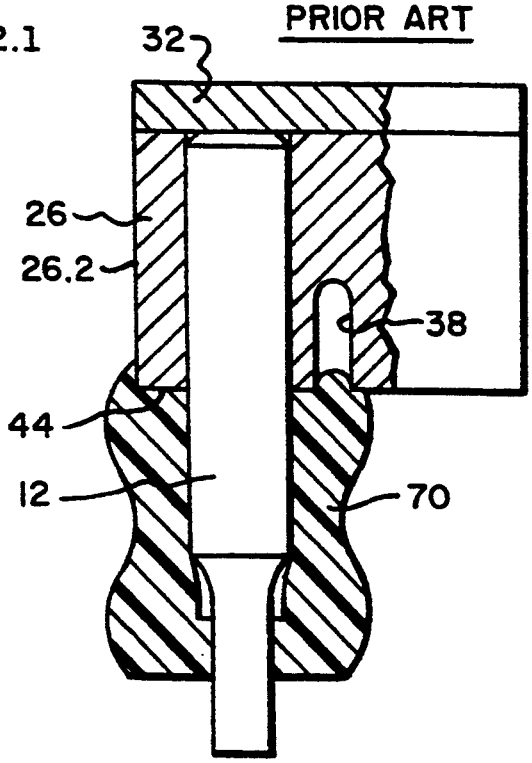
Fig. 8. PRIOR ART
FIG. 8 is a view showing a prior art stripper.

The diameters of the bores 54 and 56 in the closed and open end designs of FIGS. 2 and 6 are preferably the same, selected so that the upper and lower parts of the stripper will closely embrace the cylindrical upper shank portion of the punch. In operation, when the stripper is fully installed about the punch, as best shown in FIG. 3, the bore 54 will embrace the intermediate section 12.12 of the cylindrical upper portion of the punch. Similarly, the bore 56 will closely embrace the lower section 12.13 of the cylindrical upper portion of the punch 12. The upper part 50 has an upper surface 60 which extends normal to the axis 62 to the bores 54, 56. When the two part urethane punch stripper of this invention is assembled about the punch, the upper surface 60 will be in contact with the lower surface 44. As can be seen from FIG. 3, the retainer may not extend beyond the uppermost surface 60, at least for a portion of the retainer. This would mean that during compression of the stripper it would be possible for the edge of the retainer (defined by the intersection of the lower surface 44 and the vertical surface 26.2) to cut into, damage, or otherwise tear the upper portion of the stripper. (While the term compression is used above, it should more properly be deflection, as urethane is noncompressible and only deflects.) By utilizing a urethane in the upper portion which is substantially harder than the urethane in the lower portion, such damage is prevented. This can be seen from an inspection of the prior art punch stripper which is shown in FIG. 8, the prior art stripper 70 being shown under compression. In the prior art stripper design the edge of the retainer may cut into, damage, or otherwise tear the upper portion of the stripper 70. In addition, the retainer block 26 may also be provided with apertures 38 which extend upwardly from the lower surface 44 of the retainer, and the sharp edge between the surface 44 and the aperture 38 may also damage the stripper 70. By providing a tubular upper part 50 formed of a urethane substantially harder than the lower part of the stripper, the foregoing problems may be avoided.

As can be seen best from an inspection of FIG. 4, when the stripper is properly positioned about the punch 12, the upper and lower parts 50, 52 of the stripper have a combined length 64 which is greater than the combined length 66 of the intermediate and lower sections of the upper shank portion of the punch, the lower working end portion, and the transition portion. By having such a length a proper preload to the punch stripper can be achieved. Such a proper preload should take into account the initial set of the punch stripper which occurs after a few operations. In general, the combined length of the tubular upper and lower parts 50, 52 is 0.125 inches (3.2 mm) to 0.140 inches (3.6 mm) longer than the combined length 66 of the punch. This length will establish a proper preload.

While a preferred form of this invention has been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A two part urethane punch stripper for use with a punch having a cylindrical upper shank portion and a lower working end portion, the upper shank portion having upper, intermediate, and lower sections, the upper section of the upper shank portion being supported by a punch retainer, and the lower working end portion of the punch being adapted to contact a workpiece, the retainer being secured to a press; the two part urethane punch stripper comprising:

a generally cylindrical tubular lower part formed of a urethane of conventional hardness for a punch stripper in the range of 80A–100A (Shore), the lower part having a concentric bore, an upper portion of the bore being adapted to closely engage the lower section of the cylindrical upper shank portion of the punch;

the punch stripper being characterized by a generally cylindrical tubular upper part formed of an unadulterated urethane substantially harder than the lower part of the stripper for minimizing cutting or tearing of the stripper, the upper part having substantially the same diameter as the lower part of the punch stripper, the upper part having a concentric bore, the bore being adapted to closely engage the intermediate section of the shank portion of the punch, the upper surface of the upper part contacting the lower surface of the punch retainer when the stripper is properly positioned about a punch;

the upper and lower tubular parts being bonded to each other, and the upper and lower parts of the stripper having a combined length greater than the length of the intermediate and lower sections of the upper shank portion of the punch and the lower working end portion of the punch.

2. The two part urethane punch stripper as set forth in claim 1 wherein the upper generally cylindrical tubular part is formed of a 75D (Shore) urethane.

3. The two part urethane punch stripper as set forth in claim 1 wherein the combined length of the upper and lower tubular parts is 0.125 inches (3.2 mm) to 0.140 inches (3.6 mm) longer than the combined length of the intermediate and lower sections of the upper shank portion of the punch and the lower working end portion of the punch to establish a proper preload.

4. The combination of a two part urethane punch stripper disposed about a punch supported by a punch retainer; the combination comprising:

a punch retainer secured to a punch press, the punch retainer having a cylindrical cavity, a lower surface of the retainer extending normally to the centerline of the cavity;

a punch having a cylindrical upper shank portion and a lower working end portion, the upper shank portion having upper, intermediate, and lower sections, the upper section of the upper shank portion being supported by the punch retainer, and the lower working end portion of the punch being adapted to contact a workpiece; and a two part urethane punch stripper having a generally cylindrical tubular lower part formed of a urethane of conventional hardness for a punch stripper in the range of 80A–100A (Shore), the lower part having a concentric bore, an upper portion of the bore closely engaging the lower section of the cylindrical upper shank portion of the punch, a generally cylindrical tubular upper part formed of an unadulterated urethane substantially harder than the lower part of the stripper for minimizing cutting or tearing of the stripper, the upper part having substantially the same diameter as the lower part of the punch stripper, the upper part having a concentric bore and an upper surface normal to the bore, the bore of the upper part closely engaging the intermediate section of the shank portion of the punch, the upper surface of the upper part contacting the lower surface of the punch retainer when the stripper is properly positioned about a punch, and the upper and lower tubular parts of the punch stripper being bonded to each other, and the upper and lower parts of the stripper having a combined length greater than the length of the intermediate and lower sections of the upper shank portion of the punch and the lower working end portion of the punch.

5. The combination as set forth in claim 4 wherein the generally cylindrical tubular upper part is formed of a 75D (Shore) urethane.

6. The combination as set forth in claim 4 wherein the combined length of the tubular upper and lower parts is 0.125 inches (3.2 mm) to 0.140 inches (3.6 mm) longer than the combined length of the intermediate and lower sections of the upper shank portion of the punch and the lower working end portion of the punch to establish a proper preload.

* * * * *